US006259015B1

(12) United States Patent
Takahashi et al.

(10) Patent No.: US 6,259,015 B1
(45) **Date of Patent: *Jul. 10, 2001**

(54) ACOUSTIC SIGNAL PRODUCING APPARATUS

(75) Inventors: Makoto Takahashi; Takuya Nakata; Hiroyuki Iwase, all of Hamamatsu (JP)

(73) Assignee: Yamaha Corporation, Hamamatsu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/513,328

(22) Filed: Aug. 10, 1995

(30) Foreign Application Priority Data

Aug. 10, 1994 (JP) ..... 6-188515

(51) Int. Cl.[7] ..... G10H 1/00; G10H 1/02

(52) U.S. Cl. ..... 84/626; 84/601; 84/602; 84/603; 84/662

(58) Field of Search ..... 84/626–633, 662–665, 84/602–606, 601

(56) References Cited

U.S. PATENT DOCUMENTS

| | | | | |
|---|---|---|---|---|
| 5,109,419 | * | 4/1992 | Griesinger | 381/63 |
| 5,121,669 | * | 6/1992 | Iba et al. | 84/735 |
| 5,166,464 | * | 11/1992 | Sakata et al. | 84/662 |
| 5,278,346 | | 1/1994 | Yamaguchi . | |
| 5,308,916 | | 5/1994 | Murata et al. . | |
| 5,521,326 | * | 5/1996 | Sone | 84/631 |
| 5,569,038 | * | 10/1996 | Tubman et al. | 434/308 |
| 5,689,079 | * | 11/1997 | Kosugi | 84/603 |
| 5,703,312 | * | 12/1997 | Takahashi et al. | 84/626 |
| 5,750,914 | * | 5/1998 | Takahashi | 84/626 |

FOREIGN PATENT DOCUMENTS

| | | |
|---|---|---|
| 0 488 732 | 6/1992 | (EP) . |
| 0 509 766 | 10/1992 | (EP) . |
| 2 247 336 | 2/1992 | (GB) . |
| 61-41120 | 11/1986 | (JP) . |
| 62-175798 | 8/1987 | (JP) . |
| 4-25896 | 1/1992 | (JP) . |
| 413190 | 1/1992 | (JP) . |
| WO 88 05200 | 7/1988 | (WO) . |

OTHER PUBLICATIONS

Information Brochure for the Korg Wavestation A/D Soundmodule, issued by Korg Inc., 1991, Germany.

* cited by examiner

*Primary Examiner*—Robert E. Nappi
*Assistant Examiner*—Marlon Fletcher
(74) *Attorney, Agent, or Firm*—Morrison & Foerster

(57) ABSTRACT

An acoustic signal producing apparatus wherein various musical effects are applied to a musical tone signal and an acoustic signal respectively produced at an internal tone generator and supplied from an external device such as a microphone, an electronic musical instrument or the like in such a manner that an applying state of the musical effects can be changed in accordance with various effect control parameters applied thereto.

18 Claims, 10 Drawing Sheets

ACOUSTIC SIGNAL PRODUCING APPARATUS

BACKGROUND OF THE INVENTION

1. Field of the Invention

The present invention relates to an acoustic signal producing apparatus capable of issuing musical tone signals produced at its internal tone generator together with acoustic signals applied thereto from an external device such as a microphone, an electronic musical instrument or the like.

2. Description of the Prior Art

In recent years, there has been proposed an acoustic signal producing apparatus of the type which includes means for applying musical effects to musical tone signals produced at its internal tone generator. On the other hand, there has been proposed an acoustic apparatus capable of applying various musical effects to acoustic signals supplied thereto from an external device such as a microphone or the like.

In the prior art, however, the musical effects are independently applied to the musical tone signals and the acoustic signals at the respective apparatuses and separately controlled. It is, therefore, needed to separately change each applying state of the musical effects. This causes troublesome in manipulation of both the apparatuses.

SUMMARY OF THE INVENTION

Accordingly, it is a primary object of the present invention to provide an acoustic signal producing apparatus capable of simultaneously applying various musical effects to musical tone signals produced at its internal tone generator and acoustic signals supplied from an external device such as a microphone, an electronic musical instrument or the like and of changing each applying state of the musical effects in a simple manner.

According to the present invention, the object is accomplished by providing an acoustic signal producing apparatus which comprises tone generator means to be applied with tone pitch data indicative of a tone pitch for producing a musical tone signal of the tone pitch; input means to be applied with an acoustic signal from an external device; musical effect applying means for applying a musical effect to the musical tone signal and the acoustic signal supplied from the tone generator means and the input means and for changing an applying state of the musical effect in accordance with an effect control parameter separately supplied thereto; and automatic performance means provided to memorize the tone pitch data and the effect control parameter in a time series for successively supplying the memorized tone pitch data and effect control parameter to the tone generator means and the musical effect applying means.

According to an aspect of the present invention, there is provided an acoustic signal producing apparatus having an operation panel provided with a manual switch, which signal producing apparatus comprises tone generator means to be applied with tone pitch data indicative of a tone pitch for producing a musical tone signal of the tone pitch; input means to be applied with an acoustic signal from an external device; musical effect applying means for applying a musical effect to the musical tone signal and the acoustic signal supplied from the tone generator means and the input means and for changing an applying state of the musical effect; and switchover means for switching over the applying state of the musical effect in response to operation of the manual switch.

According to another aspect of the present invention, there is provided an acoustic signal producing apparatus wherein the switchover means comprises means for controlling the tone generator means in response to operation of the manual switch to switch over a tone color of the musical tone signal produced at the tone generator means.

BRIEF DESCRIPTION OF THE DRAWINGS

Other objects, features and advantages or the present invention will be more readily appreciated from the following detailed description of certain preferred embodiments thereof when considered with reference to the accompanying drawings, in which.

DETAILED DESCRIPTION OF THE PREFERRED EMBODIMENTS

Figure 1:
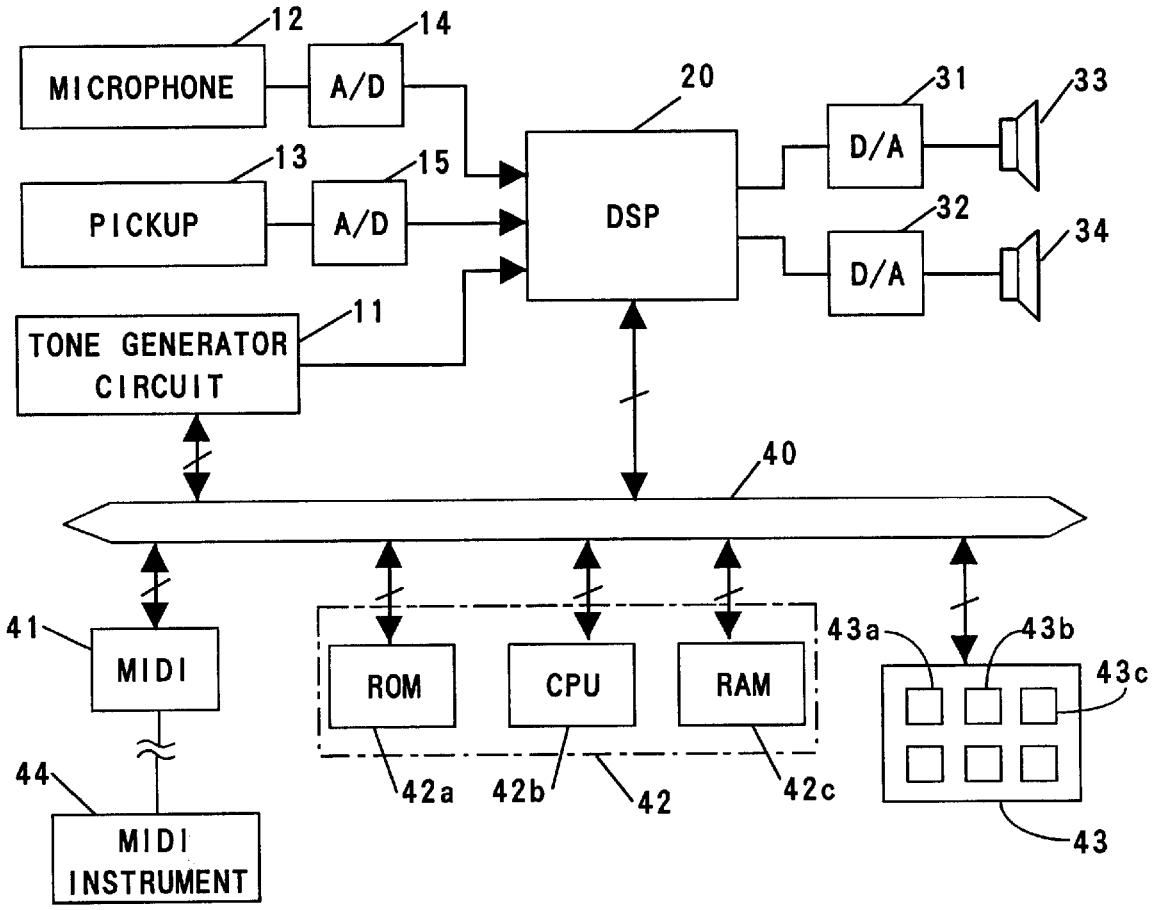
FIG. 1 is a block diagram of a first embodiment of an acoustic signal producing apparatus in accordance with the present invention.

In FIG. 1 of the drawings, there is schematically illustrated a block diagram of a first embodiment of an acoustic signal producing apparatus in accordance with the present invention. The acoustic signal producing apparatus comprises a tone generator circuit 11 and acoustic signal input means in the form of a microphone 12 and a pickup device 13. The tone generator circuit 11 is designed to produce digital musical tone signals in response to tone pitch data KC and touch data TD applied thereto. The frequency and tone volume level of the digital musical tone signals are determined by the tone pitch data KC and touch data TD applied to the tone generator circuit 11, and each tone color of the musical tone signals is determined by tone color control parameters applied to the tone generator circuit 11.

In this embodiment, the tone generator circuit 11 is constructed to simultaneously produce thirty-two musical tones as plural parts 1–32. The microphone 12 is applied with external acoustic signals such as human singing voice, musical instruments' sounds and the like. while the pickup device 13 is provided to pick up external acoustic signals such as acoustic signals caused by vibration of the strings of a piano, a guitar or the like. The microphone 12 and pickup device 13 may be housed within the acoustic signal producing apparatus or connected to the same in an appropriate manner. The microphone 12 and pickup device 13 are connected respectively through analog to digital or A/D converters 14 and 15 to a digital signal processor or DSP 20 in connection to the tone generator circuit 11.

The DSP 20 includes various arithmetic units, memories, registers, counters and their control circuits. In operation, the DSP 20 acts as a comprehensive musical effect applying means for mixing input signals applied thereto, for controlling each gain of the input signals, for delaying the input signals and for applying various musical effects such as a chorus effect, a pitch change effect, a reverberation effect, a distortion effect or the like to the input signals under control of a program. The DSP 20 has a pair of left and right channels which are connected to loudspeakers 33 and 34 respectively through digital-to-analog or D/A converters 31 and 32.

Figure 2:
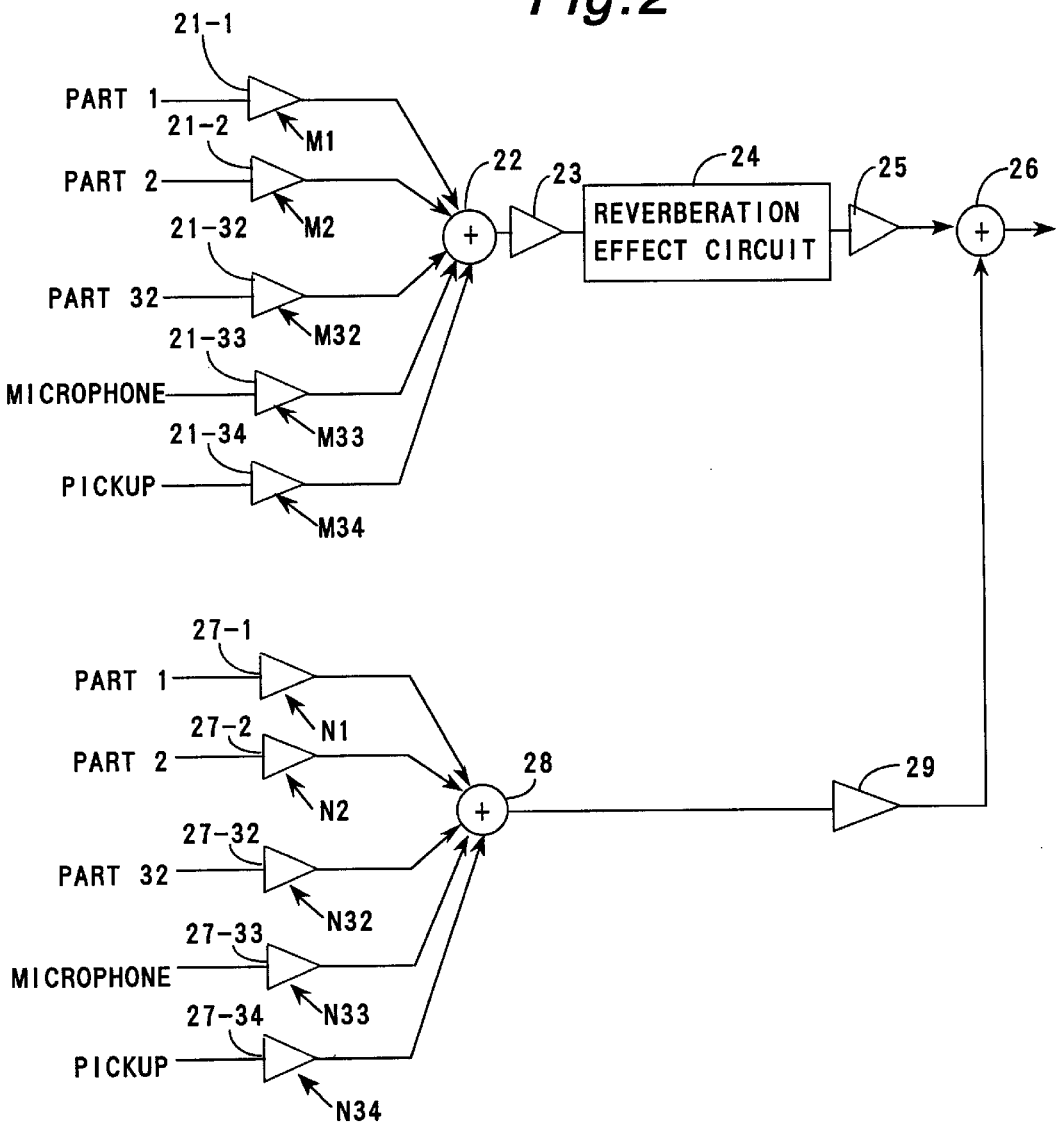
FIG. 2 is a block diagram of a digital signal processor shown in FIG. 1.

As shown in FIG. 2, the DSP 20 has first and second channels arranged in parallel to be respectively applied with musical tone signals for thirty-two tones as parts 1–32 from the tone generator circuit 11 and external acoustic signals from the microphone 12 and pickup device 13. The first channel includes a plurality of multipliers 21-1 to 21-34 for controlling each gain of the input signals and a mixer circuit 22 in the form of an adder for adding up the gain-controlled input signals. The mixer circuit 22 is connected to a reverberation effect circuit 24 through an amplifier 23. In addition, the multipliers 21-1 to 21-34 are arranged to be applied with gain control signals M1–M34 as control parameters for controlling each gain of the input signals. The reverberation effect circuit 24 is designed to apply a reverberation effect to the gain-controlled input signals and is connected to a first input of an adder 28 through an amplifier 25. The second channel includes a plurality of multipliers 27-1 to 27-34 for controlling each gain of the input signals and a mixer circuit 28 in the form of an adder for adding up the gain-controlled input signals. The mixer circuit 28 is connected to a second input of adder 26 through an amplifier 29. The multipliers 27-1 through 27-34 are arranged to be applied with gain control signals N1–N34 as control parameters for controlling each gain of the input signals. The adder 26 acts to sum up output signals of the first and second channels and apply them to the left and right output channels.

Figure 3:
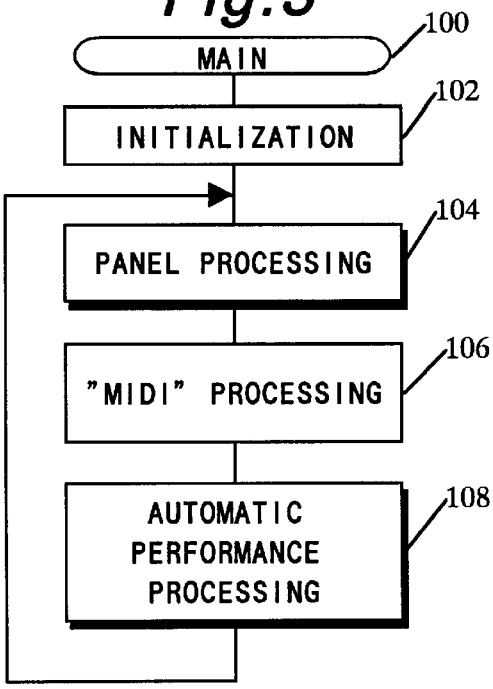
FIG. 3 is a flow chart of a main program executed by a microcomputer shown in FIG. 1.

Referring back to FIG. 1, the tone generator circuit 11 and DSP 20 are connected to a bus line 40 to which connected are a musical instrument digital interface or MIDI 41, a microcomputer 42 and an operation panel 43. The MIDI 41 is provided to define a format of music data in an electronic musical instrument and is connected to another MIDI instrument 44 such as another electronic musical instrument, a sequencer or the like to be applied with MIDI data therefrom. The computer 42 includes a read-only memory or ROM 42*a* provided to memorize a program shown by flow charts in FIGS. 3–5, a central processing unit or CPU 42*b* for execution of the program and a random access memory or RAM 42*c* provided to memorize variables necessary for execution of the program.

Figure 6:
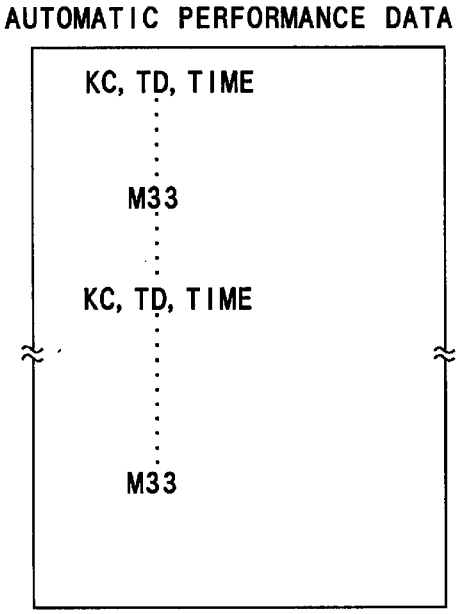
FIG. 6 is a format of automatic performance data.

In operation, automatic performance data supplied from the MIDI instrument 44 through the MIDI 41 or a flexible disc (not shown) are written into the RAM 42*c*. As shown in FIG. 6. the automatic performance data includes, in a time series, tone pitch data KC and touch data TD respectively indicative of a tone pitch frequency and a tone volume level of each musical note, interval data TIME indicative of a time interval between respective musical notes and gain control data M1–M34, N1–N34 indicative of each tone volume level of musical tone signals supplied from the tone generator circuit 11 in correspondence with parts 1–32 and external acoustic signals supplied from the microphone 12 and pickup device 13. Memorized in the ROM 42*a* are different pairs of tone color control parameters and effect control parameters respectively corresponding with plural manual switches 43*a*, 43*b*, . . . of the operation panel 43. Memorized also in the RAM 42*c* are different pairs of tone color control parameters and effect control parameters respectively corresponding with the remaining panel switches of the operation panel 43.

In the case that the acoustic signal producing apparatus is utilized as a so-called "Karaoke" where human singing voice is applied to the microphone 12 and where musical tone signals produced by the tone generator circuit 11 on a basis of the automatic performance data are applied to the DSP20 for accompaniment with the singing voice, the automatic performance data, tone color control data and effect control data are preliminarily stored in the RAM 42*a*. Assuming that in such a condition, the CPU 42*b* has initiated execution of a program shown by a flow chart in FIG. 3 at step 100, the program is initialized by the CPU 42*b* at step 102. Thereafter, the CPU 42*b* repeatedly executes a panel processing routine, a MIDI processing routine and an automatic performance processing routine respectively at step 104, 106 and 108 as described below.

Figure 4:
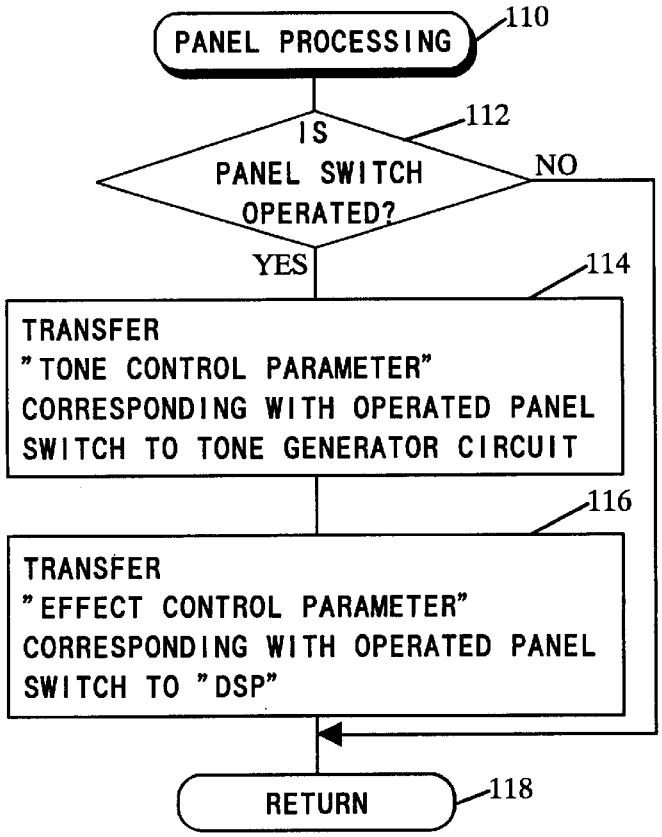
FIG. 4 is a flow chart of a panel processing routine shown In FIG. 3.
Figure 5:
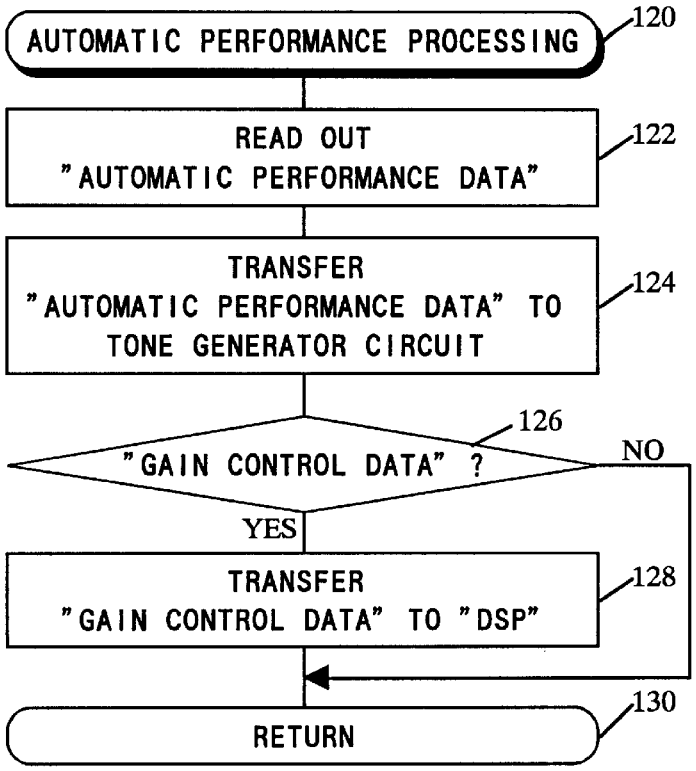
FIG. 5 is a flow chart of an automatic performance processing routine shown in FIG. 3.

The panel processing routine is shown in detail in FIG. 4. After initiated at step 110 to execute the panel processing routine, the CPU 42*b* determines at step 112 whether either one of the panel switches 43*a*, 43*b*, . . . has been operated or not. If any one of the panel switches 43*a*, 43*b*, . . . is not operated, the CPU 42*b* determines a "No" answer at step 112 and finishes execution of the panel processing routine at step 118. When either one of the panel switches is operated, the CPU 42*b* determines a "Yes" answer at step 112 and causes the program to proceed to step 114 and 116. At step 114, the CPU 42*b* reads out a tone color control parameter corresponding with the operated panel switch from the ROM 42*a* or RAM 42*c* and applies it to the tone generator circuit 11. Thus, the tone generator circuit 42 is conditioned for ready to produce a musical tone signal with a tone color defined by the tone color control parameter. Subsequently, the CPU 42*b* reads out at the following step 116 an effect control parameter corresponding with the operated panel switch from the ROM 42*a* or RAM 24*c* and applies it to the DSP 20. Thus, the DSP 20 is conditioned for ready to apply a musical effect defined by the effect control parameter to the musical tone signal from the tone generator circuit 11. After processing at step 114 and 116, the CPU 42*b* finishes execution of the panel processing routine at step 118.

During execution of the MIDI processing routine, the CPU 42*b* is applied with MIDI data from the MIDI instrument 44 through the MIDI 41 and executes processing of the MIDI data. The automatic performance processing routine is shown in detail in FIG. 5. When initiated at step 120 to execute the automatic performance processing routine, the CPU 42*b* reads out at step 122 the stored automatic performance data from the RAM 42*c*, in this instance, a time defined by each interval data TIME included in the automatic performance data is successively measured by a timer (not show), and the tone pitch data KC, touch data TD and gain control data M1–M34, N1–N34 are read out from the RAM 42*c* at each end of the measurement of the time. After read out the automatic performance data, the CPU 42*b* applies at step 124 the read out tone pitch data KC and touch data TD to the tone generator circuit 11. Thus, the tone generator circuit 11 produces a musical tone signal at a tone pitch frequency and a tone volume level defined respectively by the tone pitch data KC and touch data TD and supplies the musical tone signal to the DSP 20.

Subsequently, the CPU 42*b* determines at step 128 whether the gain control data M1–M34, N1–N34 have been read out or not. If the answer at step 126 is "No", the CPU 42*b* finishes execution of the automatic performance processing routine at step 130. Tf the answer at step 126 is "Yes", the CPU 42*b* applies at the following step 128 the read out gain control data M1–M34, N1–N34 to the DSP 20. In turn, the DSP 20 controls each gain of musical tone signals of parts 1–32 supplied from the tone generator circuit 11 and each gain of acoustic signals supplied from the microphone 12 and pickup device 13 in accordance with the applied gain control data M1–M34, N1–N34, respectively at the multipliers 21-1 to 21-34 of the first channel and at the multipliers 27-1 to 27-34 of the second channel. In such an instance, output signals of the multipliers 21-1 to 21-34 are added up at the adder 22 and supplied to the reverberation effect circuit 24 through the amplifier 23, while output signals of the multipliers 27-1 through 27-34 are added up at the adder 28 and supplied to the adder 26 through the amplifier 29. Thus, the adder 26 adds up the supplied output signals and applies them to the left and right output channels, respectively. These output signals are converted into analog signals at the D/A converters 31, 32 and applied to the speakers 33 and 34 through the amplifier 25 as acoustic analog signals.

Figure 7:
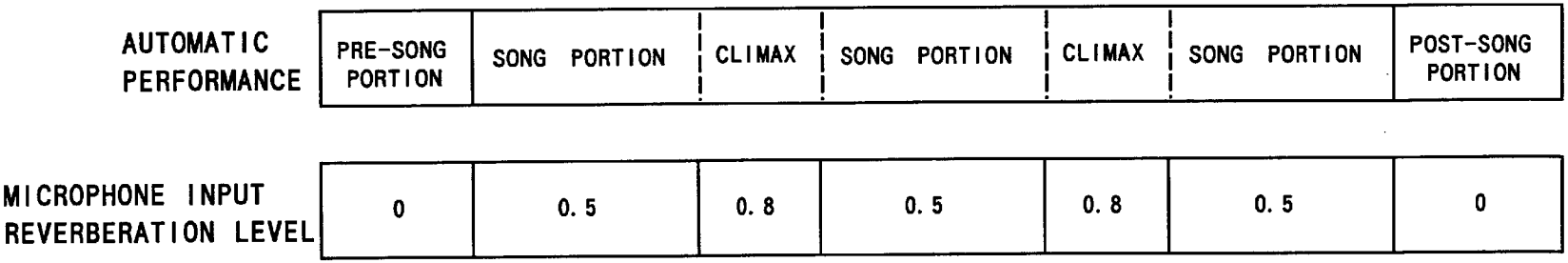
FIG. 7 illustrates a changing state of automatic performance and a changing state of a reverberation level.

In a practical embodiment where the musical tone signals from the tone generator circuit 11 are utilized for accompaniment with the singing voice, pre-song, song and post-song portions are performed by the automatic performance as shown in FIG. 7. Assuming that in this instance, the gain control data M33 is applied as "0" during performance of the pre-song and post-song portions, as "0.5" during performance of the song portion and as "0.8" during performance of climax portions, noises are reduced under absence of the singing voice, and the singing voice is sounded with accompaniment enhanced by a reverberation effect at a climax portion of the music in accordance with progression of the music. It is, therefore, able to automatically sound musical tone signals with external acoustic signals in a simple manner.

Figure 8:
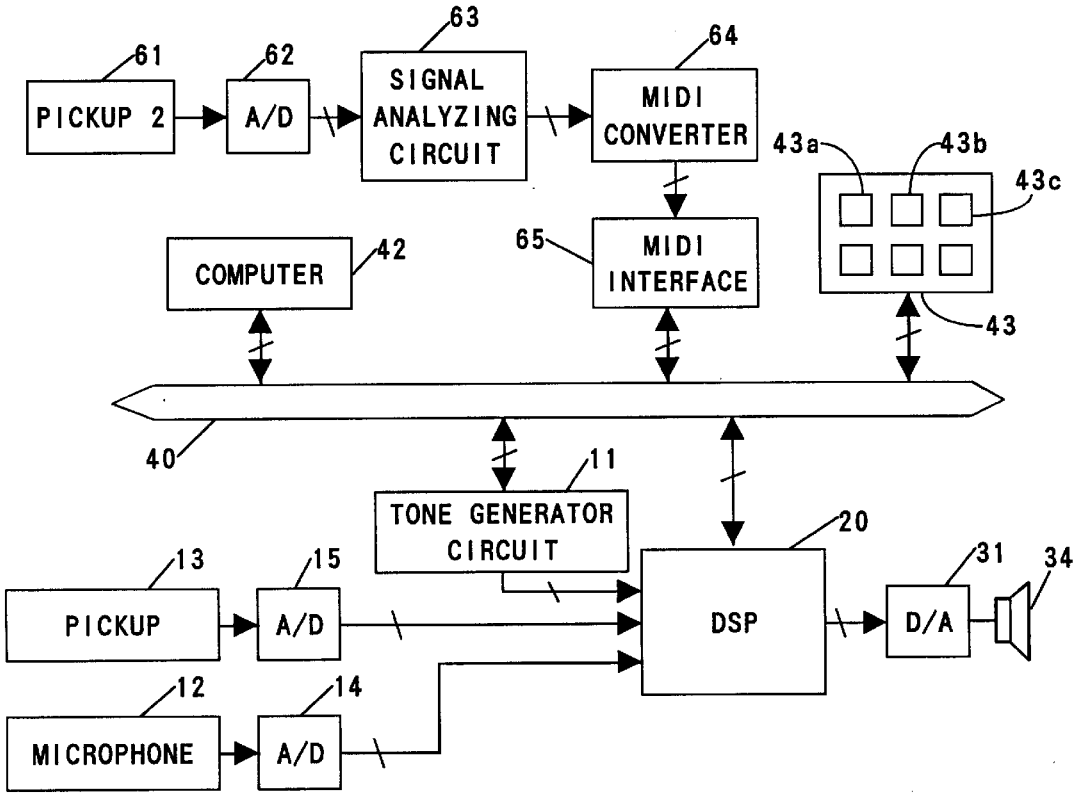
FIG. 8 is a block diagram of a second embodiment of an acoustic signal producing apparatus in accordance with the present invention.
Figure 9A:
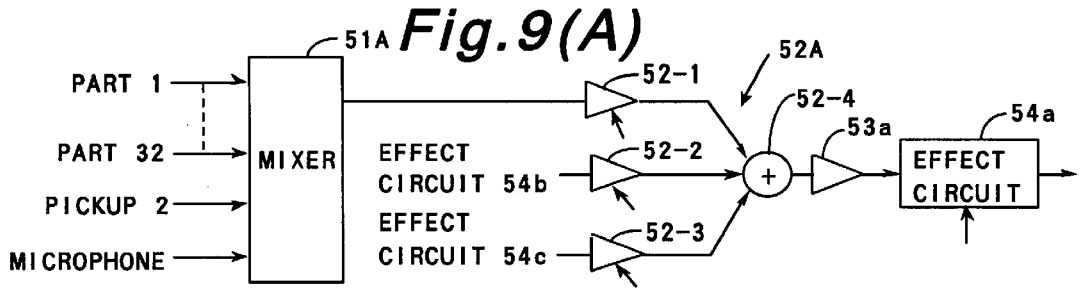
FIGS. 9(A)–9(D) each are a block diagram of a digital signal processor shown in FIG. 8.
Figure 9B:
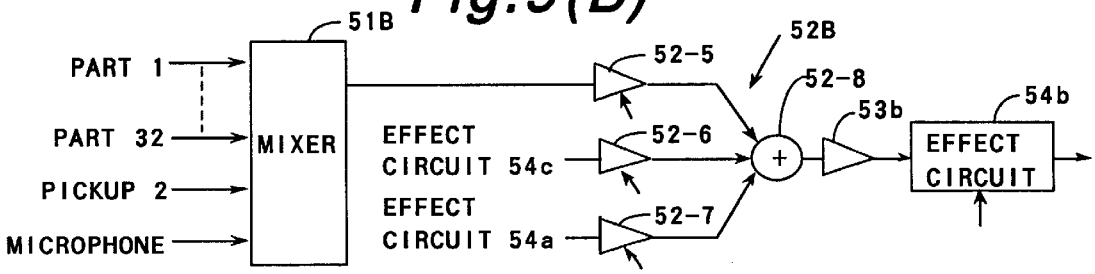
Figure 9C:
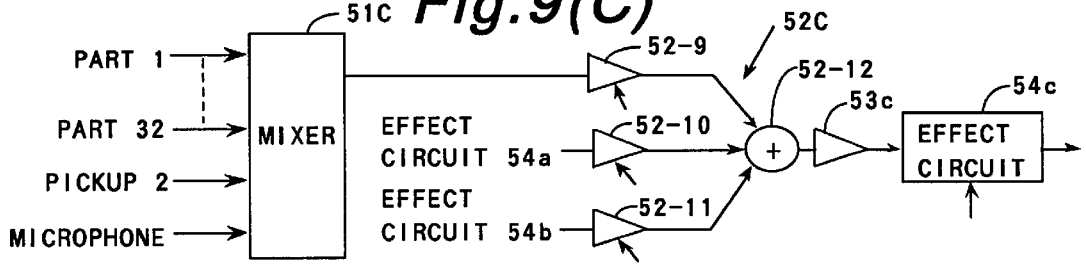
Figure 9D:
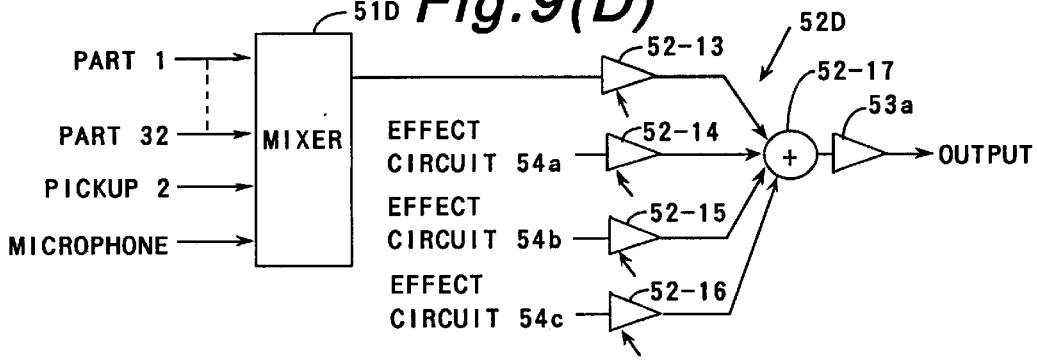
Figure 10:
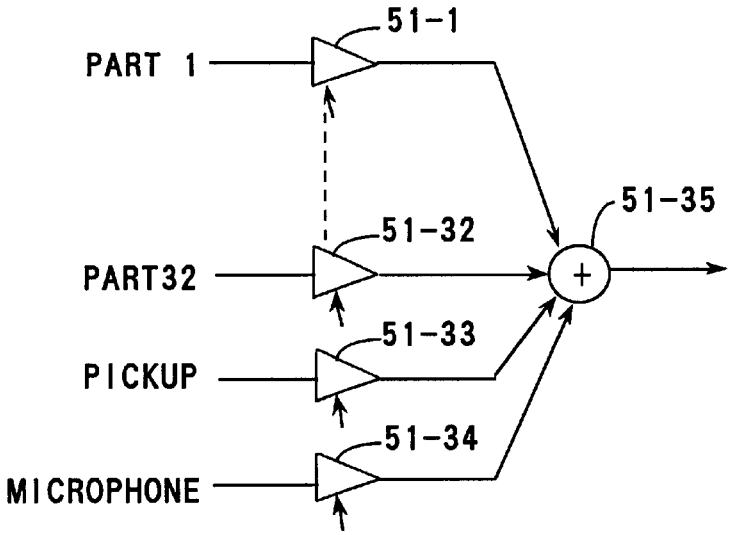
FIG. 10 is a circuit diagram of a mixer circuit shown in FIG. 9.

Illustrated in FIG. 8 is a second embodiment of an acoustic signal producing apparatus in accordance with the present invention, wherein the same component parts and portions as those in the first embodiment are designated by the same reference numerals. In this second embodiment, the CPU 42*b* of the computer 42 is arranged to execute programs shown by flow charts in FIGS. 11 and 12, and the panel. switches 43*a*, 43*b*, . . . are adapted to switch over each tone color of musical tone signals at the tone generator circuit 11 and to switch over a musical effect applying state at the DSP 20. In addition, as shown in FIGS. 9(A)–9(D), the DSP 20 is arranged to be applied with musical tone signals for thirty-two tones as parts 1–32 from the tone generator circuit 11. The DSP 20 includes mixer circuits 51A–51D arranged to mix the musical tone signals with the external acoustic signals applied from the microphone 12 and pickup device 13. As shown in FIG. 10, the mixer circuits 51A–51D each include multipliers 51-1 to 51-34 for controlling each gain of the musical tone signal and the external acoustic signals and an adder 51-35 for adding up the gain-controlled signals. The multipliers 51-1 to 51-34 each are arranged to be applied with gain control data as control parameters for controlling each gain of the external acoustic signals.

As illustrated in FIGS. 9(A)–9(D), the output of mixer circuit 51A is connected to an input of an adder 52-4 through a multiplier 52-1, and the other inputs of adder 52-4 are connected to effect circuits 54*b*, 54*c* respectively through multipliers 52-2 and 52-3. The output of adder 52-4 is connected to an effect circuit 54*a* through a multiplier 53*a*. The output of mixer circuit 51B is connected through a multiplier 52-5 to an input of an adder 52-8 to which connected is each output of the effect circuits 54*c*, 54*a* through multipliers 52-6 and 52-7. The output of adder 52-8 is connected to the effect circuit 54*b* through a multiplier 53*b*. The output of mixer circuit 51C is connected to an adder 52-12 through a multiplier 52-9, and the other inputs of adder 52-12 are connected to each output of effect circuits 54*a*, 54*b* through multipliers 52-10 and 52-11. The output of adder 52-12 is connected to the effect circuit 54c through a multiplier 53*c*.

The output of mixer circuit 51D is connected to an input of an adder 52-17 through a multiplier 52-13, and the other inputs of adder 52-17 are connected to each output of effect circuits 54*a*, 54*b*, 54*c* respectively through multipliers 52-14, 52-15, 52-16. The output of adder 52-17 is connected to the output channel of the DSP 20 through the multiplier 53*a*. The multipliers 52-1 to 52-3, 52-5 to 52-7. 52-9 to 52-11, 52-13 to 52-18, 53*a*–53*c* are arranged to be applied with gain control data as a control parameter for controlling each gain of the input signals. The effect circuits 54*a*–54*c* are arranged to apply various effects such as a chorus effect, a distortion effect, a reverberation effect, a pitch-change effect or the like to the input signals. The kinds of these effects are switched over by the effect control parameter applied to the DSP 20.

Referring back to FIG. 8, the acoustic signal producing apparatus includes a second pickup device 61 which is arranged to pick up vibration of the strings of a piano, a guitar or other stringed musical instruments for producing a pickup signal indicative of vibration of the strings. The output of second pickup device 81 is connected to a signal analyzing circuit 63 through an analog-to-digital or A/D converter 62. The signal analyzing circuit 63 is provided to analyze the pickup signal applied thereto from the second pickup device 61 through the A/D converter 62 for detecting the frequency and tone volume level of the pickup signal. An electric signal indicative of the detected frequency and tone volume level is supplied to a MIDI converter 64 which converts the supplied electric signal into MIDI data and applies it to the bus line 40 through a MIDI interface 65.

In the case that the acoustic signal producing apparatus is utilized to sing to the guitar, a tone color control parameter and an effect control parameter are stored in the RAM 42*c*. Assuming that the player's voice has been applied to the microphone 12 while the pickup devices 13 and 61 have picked up vibration of the strings of the guitar, acoustic signals respectively indicative of the player's voice and vibration of the guitar strings picked up by the first pickup device 13 are converted into digital signals at the A/D converters 14, 15 and supplied as digital acoustic signals to the DSP 20 while acoustic signals indicative of vibration of the guitar strings picked up by the second pickup device 61 are converted into digital signals at the A/D converter 62 and supplied as digital acoustic signals to the signal analyzing circuit 63. In turn, the signal analyzing circuit 63 analyzes the digital acoustic signals to produce signals indicative of each frequency and tone volume level of the digital acoustic signals. The signals indicative of the frequency and tone volume level are converted into MIDI data at the MIDI converter 84 and supplied to the bus line 40 through the MIDI interface 65.

Figure 11:
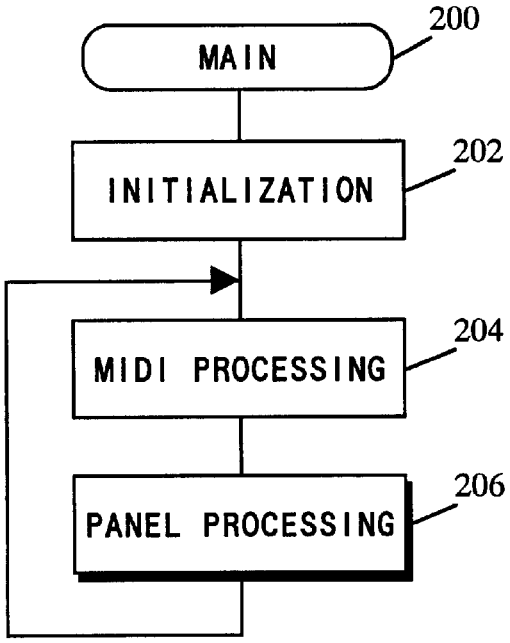
FIG. 11 is a flow chart of a main program executed by the computer shown in FIG. 8.

Simultaneously, the CPU 42*b* of computer 42 initiates execution of the program of FIG. 11 at step 200 and repeatedly executes a MIDI processing routine at step 204 and a panel processing routine at 206 after initialization of the program at step 202. During execution of the MIDI processing routine at step 204, the CPU 42*b* acts to transfer the MIDI data to the tone generator circuit 11. When applied with the MIDI data, the tone generator circuit 11 produces musical tone signals of the extracted frequency and tone volume level and supplies them to the DSP 20. Thus, the DSP 20 is supplied with the musical tone signals produced at the tone generator circuit 11 and the guitar acoustic signals and voice signals respectively picked up at the first pickup device 13 and microphone 12.

Figure 12:
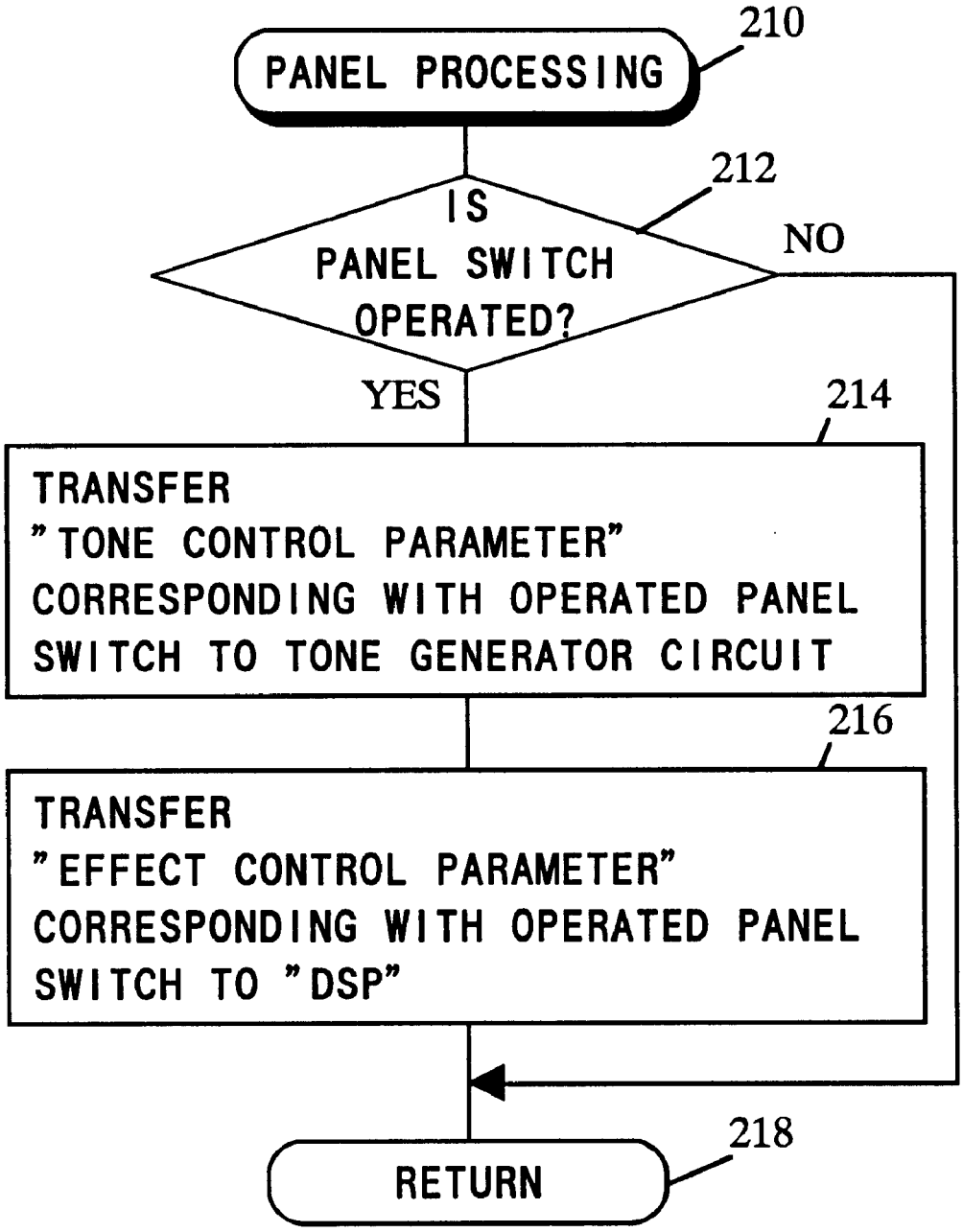
FIG. 12 is a flow chart of a panel processing routine shown in FIG. 11.

The panel processing routing is shown in detail in FIG. 12. When initiated execution of the panel processing routine at step 210, the CPU 42*b* determines at step 212 whether either one of the panel switches 43*a*, 43*b*, . . . has been operated or not. If the answer at step 212 is "No", the CPU 42*b* finishes execution of the panel processing routine at step 218. If the answer at step 212 is "Yes", the CPU 42*b* causes the program to proceed to step 214 and 218. At step 214, the CPU 42*b* reads out a tone color control parameter corresponding with the operated panel switch from the ROM 42*a* or RAM 42*c* and transfers it to the tone generator circuit 11. Thus, the tone generator circuit 11 produces a musical tone signal of a tone color defined by the tone color parameter. At the following step 216, the CPU 42*b* reads out an effect control parameter corresponding with the operated panel switch from the ROM 42*a* or RAM 42*c* and supplies it to the DSP 20. When supplied with the effect control parameter, the DSP 20 applies a musical effect defined by the effect control parameter to the input signals. After processing at step 214 and 216. the CPU 42*b* finishes execution of the panel processing routine at step 218.

As a result of the foregoing processing. when the panel switches 43*a*, 43*b*, . . . are selectively operated in accordance with progression of the music, the tone generator circuit 11 is supplied with various tone color control parameters while the DSP 20 is supplied with various effect control parameters. For instance, along with progression of a music shown in FIG. 13, the tone generator circuit 11 is successively supplied with tone color control parameters indicative of first to fourth tone colors 1–4 while the effect circuit 54*a* in the DSP 20 is successively supplied with effect control parameters suitable for the tone colors. In response to supply of the tone color control parameters to the effect circuit 54*a*, the effect circuit 54*b* in the DSP 20 is successively supplied with effect control parameters respectively indicative of a chorus effect, a distortion effect and a chorus effect while the effect circuit 54*c* in the DSP 20 is successively supplied with effect control parameters respectively indicative of a pitch change effect and a reverberation effect.

In such an instance as described above, the multipliers 51-1 to 51-34 of the mixer circuits 51A to 51C, the multipliers 52-1 to 52-3, 52-5 to 52-7, 52-9 to 52-11, 52-13 to 16 of the mixer circuits 51A to SID and the multipliers 53*a* to 53*c* are applied with gain control data as effect control parameters under control of the CPU 42*b* so that the effect circuits 54*a*, 54*b* and 54*c* are supplied with the musical tone signals, guitar acoustic signals and player's voice signals respectively from the tone generator circuit 11, the first pickup device 13 and the microphone 12.

Figure 13:
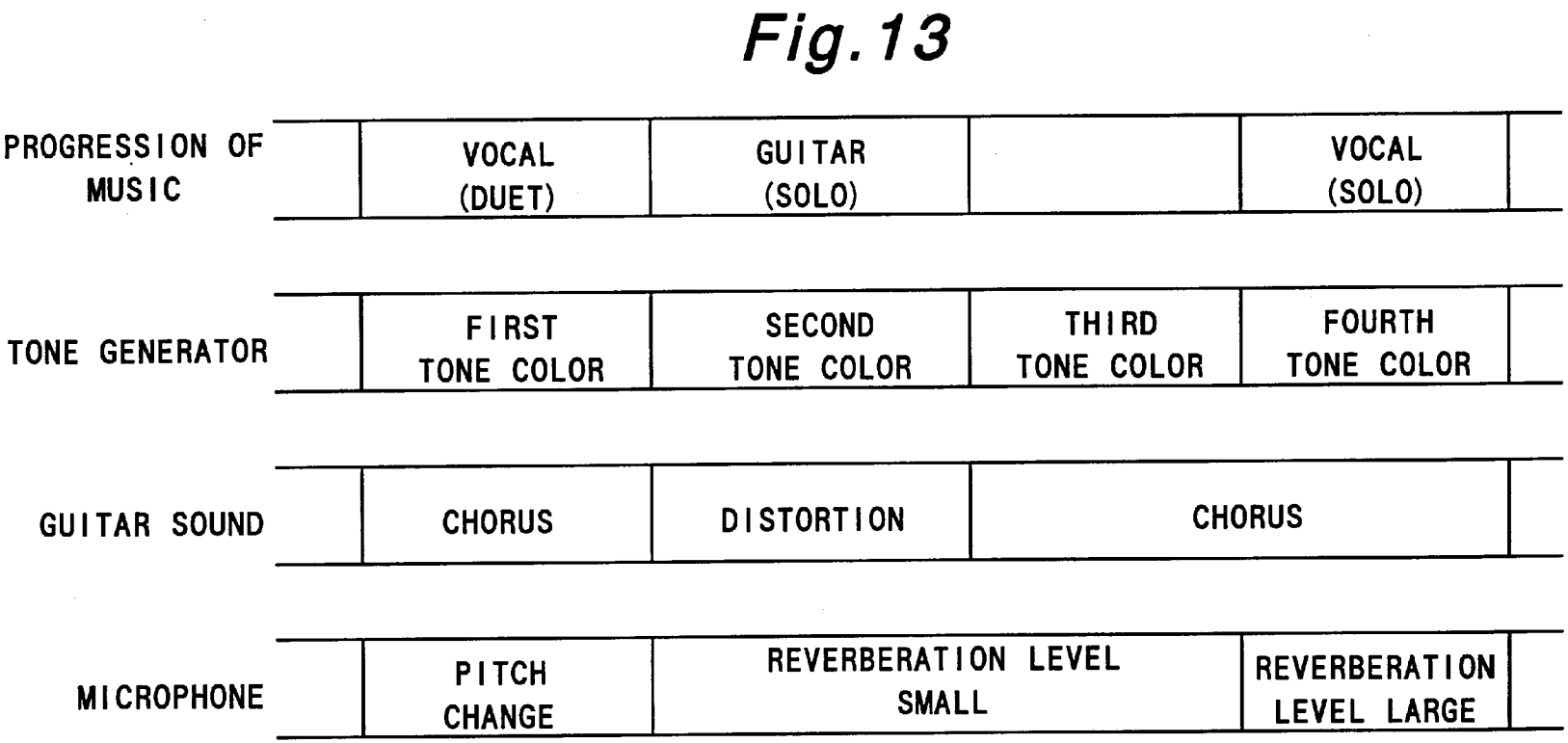
FIG. 13 illustrates an applying state of musical effects along with progression of a music.

As a result, as shown in FIG. 13, the musical tone signals, the guitar acoustic signals and player's voice signals are applied with various musical effects by operation of the panel switches 43*a*, 43*b*, . . . along with progression of the music, and simultaneously each tone color of the musical tone signals is switched over to produce musical sounds applied with various musical effects in accordance with progression of the music.

Although in the second embodiment, the operation panel 43 is provided with the plural switches 43*a*, 48*b*, . . . for switchover of each tone color of the musical tone signals and the musical effect applying state, only one switch may be provided on the operation panel 43 to successively switch over each tone color of the musical tone signals and the musical effect applying state. In such a case, the kinds of tone colors and musical effects to be switched over in accordance with progression of a music and specific parameters thereof are prepared by edition prior to performance of the music to be successively supplied to the tone generator circuit 11 and DSP 20 in response to operation of the panel switch.

What is claimed is:

1. An acoustic signal producing apparatus comprising:

a data supply device arranged to supply performance data including tone pitch data and an effect control parameter;

an input device arranged to be applied with an acoustic signal from an external device, wherein said input device converts said acoustic signal into a corresponding digitized acoustic signal, having the form of a digital signal;

a tone generator for producing a musical tone signal in the form of a digital signal at a tone pitch defined by the tone pitch data supplied from said data supply device; and a digital signal processor connected to said input device and said tone generator for simultaneously applying a selected musical effect to each of the digitized acoustic signal and the musical tone signal respectively supplied from said input device and said tone generator and for independently controlling each musical effect applied to the digitized acoustic and musical tone signals in accordance with the effect control parameter supplied from said data supply device.

2. An acoustic signal producing apparatus as recited in claim 1, wherein said input device is in the form of a microphone to be applied with human singing voice.

3. An acoustic signal producing apparatus as recited in claim 1, wherein said input device is in the form of a pickup device arranged to pick up an acoustic signal applied from an electronic musical instrument.

4. An acoustic signal producing apparatus comprising:

a memory device arranged to memorize automatic performance data including tone pitch data and gain control data in a time series and an effect control parameter;

an input device arranged to be applied with an acoustic signal from an external device, wherein said input device converts said acoustic signal into a corresponding digitized acoustic signal, having the form of a digital signal;

a tone generator for producing a musical tone signal in the form of a digital signal at a tone pitch defined by the memorized tone pitch data supplied from said memory device; and a digital signal processor for controlling each gain of the digitized acoustic signal and the musical tone signal respectively supplied from said input device and said tone generator on a basis of the memorized gain control data supplied from said memory device, for simultaneously applying a selected musical effect to each of the gain-controlled signals and for independently controlling each musical effect applied to the gain-controlled signals in accordance with the memorized effect control parameter supplied from said memory device.

5. An acoustic signal producing apparatus having an operation panel provided with a manual switch, comprising:

a memory device arranged to memorize automatic performance data including tone pitch data and gain control data in a time series and an effect control parameter determined by operation of said manual switch;

an input device arranged to be applied with an acoustic signal from an external device, wherein said input device converts said acoustic signal into a corresponding digitized acoustic signal, having the form of a digital signal;

a tone generator for producing a musical tone signal in the form of a digital signal at a tone pitch defined by the memorized tone pitch data supplied from said memory device; and a digital signal processor for controlling each gain of the digitized acoustic signal and the musical tone signal respectively supplied from said input device and said tone generator on a basis of the memorized gain control data supplied from said memory device, for simultaneously applying a selected musical effect to the gain-controlled signals and for independently controlling each musical effect applied to the gain-controlled signals in accordance with the memorized effect control parameter supplied from said memory device.

6. An acoustic signal producing apparatus comprising:

a memory device arranged to memorize automatic performance data including tone pitch data, touch data and gain control data in a time series, a tone color control parameter and an effect control parameter;

an input device arranged to be applied with an acoustic signal from an external device, wherein said input device converts said acoustic signal into a corresponding digitized acoustic signal, having the form of a digital signal;

a tone generator for producing a musical tone signal in the form of a digital signal with a tone color defined by the memorized tone color control parameter at a tone pitch frequency and a tone volume level respectively defined by the memorized tone pitch data and touch data supplied from said memory device; and a digital signal processor for controlling each gain of the digitized acoustic signal and the musical tone signal respectively supplied from said input device and said tone generator on a basis of the gain control data supplied from said memory device, for simultaneously applying a selected musical effect to each of the gain-controlled signals and for independently controlling each musical effect applied to the gain-controlled signals in accordance with the memorized effect control parameter supplied from said memory device.

7. An acoustic signal producing apparatus having an operation panel provided with a plurality of manual switches, comprising:

a memory device arranged to memorize automatic performance data including tone pitch data, touch data and gain control data in a time series, a tone color control parameter and an effect control parameter determined by operation of said manual switches;

an input device arranged to be applied with an acoustic signal from an external device, wherein said input device converts said acoustic signal into a corresponding digitized acoustic signal, having the form of a digital signal;

a tone generator for producing a musical tone signal in the form of a digital signal with a tone color defined by the memorized tone color control parameter at a tone pitch frequency and a tone volume level respectively defined by the memorized tone pitch data and touch data supplied from said memory device; and a digital signal processor for controlling each gain of the digitized acoustic signal and the musical tone signal respectively supplied from said input device and said tone generator on a basis of the memorized gain control data supplied from said memory device, for simultaneously applying a selected musical effect to each of the gain-controlled signals and for independently controlling each musical effect applied to the gain-controlled signals in accordance with the memorized effect control parameter supplied from said memory device.

8. A method for applying a selected musical effect to a plurality of musical tone signals in the form of digital signals supplied from a tone generator and a digitized acoustic signal, having the form of a digital signal, supplied from an external device, comprising the steps of:

memorizing automatic performance data including tone pitch data and gain control data in a time series and an effect control parameter;

applying the memorized automatic performance data to said tone generator to produce the musical tone signals in the form of digital signals at a tone pitch frequency defined by the memorized tone pitch data;

controlling each gain of the musical tone signals and the digitized acoustic signal respectively supplied from said tone generator and said external device on a basis of the memorized gain control data;

simultaneously applying the selected musical effect to each of the gain-controlled signals; and independently controlling each musical effect applied to the gain-controlled signals in accordance with the memorized control parameter.

9. A method for applying a selected musical effect to a plurality of musical tone signals in the form of digital signals supplied from a tone generator and a digitized acoustic signal, having the form of a digital signal, supplied from an external device, comprising the steps of:

memorizing automatic performance data including tone pitch data and gain control data in a time series and an effect control parameter determined by operation of a manual switch;

applying the memorized automatic performance data to said tone generator to produce the musical tone signals in the form of digital signals at a tone pitch frequency defined by the memorized tone pitch data;

controlling each gain of the musical tone signals and the digitized acoustic signal respectively supplied from said tone generator and said external device on a basis of the memorized gain control data;

simultaneously applying the selected musical effect to each of the gain-controlled signals; and independently controlling each musical effect applied to the gain-controlled signals in accordance with the memorized effect control parameter.

10. A method for applying a selected musical effect to a musical tone signal in the form of a digital signal supplied from a tone generator and a digitized acoustic signal, having the form of a digital signal, supplied from an external device, comprising the steps of:

memorizing automatic performance data including tone pitch data, touch data and gain control data in a time series, a tone color control parameter and an effect control parameter;

applying the memorized performance data to said tone generator to produce the musical tone signal in the form of a digital signal with a tone color defined by the memorized tone color control parameter at a tone pitch frequency and a tone volume level respectively defined by the memorized tone pitch data and touch data;

controlling each gain of the musical tone signal and the digitized acoustic signal respectively supplied from said tone generator and said external device on a basis of the memorized gain control data;

simultaneously applying the selected musical effect to each of the gain-controlled signals; and independently controlling each musical effect applied to the gain-controlled signals in accordance with the memorized effect control parameter.

11. A machine readable media for an acoustic signal producing apparatus having an input device, a tone generator, a memory device and a signal processor, said machine readable media being programmed to execute the steps of memorizing automatic performance data including tone pitch data and gain control data in a time series and an effect control parameter in said memory, applying the memorized tone pitch data to said tone generator for producing a musical tone signal in the form of a digital signal at a tone pitch defined by the memorized tone pitch data, controlling each gain of a digitized acoustic signal, having the form of a digital signal, supplied to said input device from an external device and the musical tone signal supplied from said tone generator on a basis of the memorized gain control data, simultaneously applying a selected musical effect to each of the gain-controlled signals, and independently controlling each musical effect applied to the gain-controlled signals in accordance with memorized effect control parameter.

12. An acoustic signal producing apparatus comprising:

a memory device containing stored automatic performance data including tone pitch data and an effect control parameter;

an input device adapted to receive an acoustic signal from an external device, said input device providing a digitized acoustic signal corresponding to said acoustic signal;

a tone generator coupled to said memory device and being adapted to receive said stored automatic performance data therefrom, said tone generator providing a musical tone signal at a tone pitch defined by the tone pitch data; and a digital signal processor coupled to said tone generator and said input device, said digital signal processor being adapted to simultaneously apply a selected musical effect to each of the digitized acoustic signal and the musical tone signal respectively received from said input device and said tone generator, said selected musical effect being provided by said digital signal processor in accordance with the effect control parameter.

13. An acoustic signal producing apparatus as recited in claim 12, wherein said input device further comprises a microphone.

14. An acoustic signal producing apparatus as recited in claim 12, wherein said input device further comprises a pickup device.

15. An acoustic signal producing apparatus comprising:

a memory device containing stored automatic performance data including tone pitch data and gain control data in a time series and an effect control parameter;

an input device adapted to receive an acoustic signal from an external device, said input device providing a digitized acoustic signal corresponding to said acoustic signal;

a tone generator coupled to said memory device and being adapted to receive said stored automatic performance data therefrom, said tone generator providing a musical tone signal at a tone pitch defined by the tone pitch data; and a digital signal processor coupled to said tone generator and said input device, said digital signal processor being adapted to control gain of each of the digitized acoustic signal and the musical tone signal respectively received from said input device and said tone generator based on the gain control data received from said memory device, said digital signal processor applying a selected musical effect to each of the gain-controlled signals and independently controlling each musical effect in accordance with the effect control parameter.

16. An acoustic signal producing apparatus having an operation panel provided with a manual switch, comprising:

a memory device containing stored automatic performance data including tone pitch data and gain control data in a time series and an effect control parameter determined by operation of said manual switch;

an input device adapted to receive an acoustic signal from an external device, said input device providing a digitized acoustic signal corresponding to said acoustic signal;

a tone generator coupled to said memory device and being adapted to receive said stored automatic performance data therefrom, said tone generator providing a musical tone signal at a tone pitch defined by the tone pitch data; and a digital signal processor coupled to said tone generator and said input device, said digital signal processor being adapted to control each gain of the digitized acoustic signal and the musical tone signal respectively received from said input device and said tone generator based on the gain control data, said digital signal processor simultaneously applying a selected musical effect to the gain-controlled signals and independently controlling each musical effect applied to the gain-controlled signals in accordance with the effect control parameter.

17. An acoustic signal producing apparatus comprising:

a memory device containing stored automatic performance data including tone pitch data, touch data and gain control data in a time series, a tone color control parameter and an effect control parameter;

an input device adapted to receive an acoustic signal from an external device, said input device providing a digitized acoustic signal corresponding to said acoustic signal;

a tone generator coupled to said memory device and being adapted to receive said stored automatic performance data therefrom, said tone generator providing a musical tone signal with a tone color defined by the tone color control parameter at a tone pitch frequency and a tone volume level respectively defined by the tone pitch data and touch data; and a digital signal processor coupled to said tone generator and said input device, said digital signal processor being adapted to control each gain of the digitized acoustic signal and the musical tone signal respectively received from said input device and said tone generator based on the gain control data, said digital signal processor simultaneously applying a selected musical effect to each of the gain-controlled signals and independently controlling each musical effect applied to the gain-controlled signals in accordance with the effect control parameter.

18. An acoustic signal producing apparatus having an operation panel provided with a plurality of manual switches, comprising:

a memory device containing stored automatic performance data including tone pitch data, touch data and gain control data in a time series, a tone color control parameter and an effect control parameter determined by operation of said manual switches;

an input device adapted to receive an acoustic signal from an external device, said input device providing a digitized acoustic signal corresponding to said acoustic signal;

a tone generator coupled to said memory device and being adapted to receive said stored automatic performance data therefrom, said tone generator providing a musical tone signal with a tone color defined by the tone color control parameter at a tone pitch frequency and a tone volume level respectively defined by the tone pitch data and touch data; and a digital signal processor coupled to said tone generator and said input device, said digital signal processor being adapted to control each gain of the digitized acoustic signal and the musical tone signal respectively received from said input device and said tone generator based on the gain control data, said digital signal processor simultaneously applying a selected musical effect to each of the gain-controlled signals and independently controlling each musical effect applied to the gain-controlled signals in accordance with the effect control parameter.

* * * * *